US006543656B1

(12) United States Patent
Sahai

(10) Patent No.: US 6,543,656 B1
(45) Date of Patent: Apr. 8, 2003

(54) METHOD AND APPARATUS FOR CONTROLLING STANDING SURFACE WAVE AND TURBULENCE IN CONTINUOUS CASTING VESSEL

(75) Inventor: Yogeshwar Sahai, Powell, OH (US)

(73) Assignee: The Ohio State University, Columbus, OH (US)

( * ) Notice: Subject to any disclaimer, the term of this patent is extended or adjusted under 35 U.S.C. 154(b) by 0 days.

(21) Appl. No.: 09/698,858

(22) Filed: Oct. 27, 2000

(51) Int. Cl.[7] ..... B22D 41/08
(52) U.S. Cl. ..... 222/594; 222/606; 164/437
(58) Field of Search ..... 222/590, 594, 222/606, 607; 164/437

(56) References Cited

U.S. PATENT DOCUMENTS

| | | | | | |
|---|---|---|---|---|---|
| 3,669,181 | A | * | 6/1972 | Schrewe | 164/437 |
| 3,951,317 | A | * | 4/1976 | Hosokawa et al. | 164/437 |
| 4,015,655 | A | * | 4/1977 | Fastner et al. | 164/437 |
| 4,160,387 | A | | 7/1979 | Ihara et al. | 73/639 |
| 4,457,356 | A | | 7/1984 | Hasebe et al. | 164/478 |
| 4,590,989 | A | | 5/1986 | Kobayashi | 164/504 |
| 4,819,840 | A | * | 4/1989 | Lax et al. | 222/606 |
| 4,858,794 | A | | 8/1989 | Sugiura et al. | 22/606 |
| 4,993,477 | A | | 2/1991 | Praeg | 164/453 |
| 5,307,863 | A | | 5/1994 | Kubota et al. | 164/466 |
| 5,375,648 | A | | 12/1994 | Idogawa et al. | 164/471 |

FOREIGN PATENT DOCUMENTS

| | | | | |
|---|---|---|---|---|
| JP | 363076753 A | * | 4/1988 | 222/606 |
| JP | 63076753 A | | 7/1988 | |

* cited by examiner

*Primary Examiner*—Scott Kastler

(57) ABSTRACT

The apparatus of the present invention includes a molten metal vessel system for casting molten metal, the system comprising: (a) a vessel containing a molten metal adapted to contain and dispense the molten metal for casting, the vessel having interior surfaces and the molten metal forming an upper surface; (b) a submerged entry nozzle extending below the upper surface; and (c) a surface flow modifier member disposed between at least one of the interior surfaces and the submerged entry nozzle, and in sufficient proximity to the upper surface of the molten metal so as to impede the formation of waves in the upper surface of the molten metal. The present invention also includes a method of providing a flow of molten metal for continuous casting.

14 Claims, 10 Drawing Sheets

METHOD AND APPARATUS FOR CONTROLLING STANDING SURFACE WAVE AND TURBULENCE IN CONTINUOUS CASTING VESSEL

TECHNICAL FIELD OF THE INVENTION

The present invention is in the field of continuous steel casting.

BACKGROUND OF THE INVENTION

In continuous casting of steel, molten metal is poured from a large vessel called a "Tundish" into a water-cooled copper mold by using a submerged entry nozzle ("SEN"). Steel begins to solidify as it comes in contact with the walls of the copper mold, the slab descending down continuously at the casting rate. The thickness in a slab caster mold typically is about 9 to 12 inches, whereas in a thin slab caster the thickness is only about 2 to 4 inches. The width of the slab is generally very large, typically 60 to 72 inches. A layer of mold flux is maintained at the free surface of the as metal, which protects the hot metal from atmospheric oxidation and provides a thin lubricating layer between the descending slab and the mold walls.

Several fluid flow studies of slab caster molds have shown that the flow of molten metal in a mold has a large influence on the surface and subsurface quality of the resultant cast metal. The molten metal exiting the SEN is at an angle relative to the horizontal and impinges on the narrow wall. This results in the formation of upper and lower recirculating flows, which are schematically shown in a general flow pattern in FIG. 1. The upper recirculation causes a standing wave at the free surface. The height of the Wave typically oscillates with time. This oscillating standing wave and associated turbulence at the free surface is considered to be the main reason for most of the defects in cast slabs made by this process.

Due to other physical factors (e.g., the slide gate and non-uniform nozzle blockage) and turbulence, the patterns on the two sides in the mold may not be symmetrical and may continuously change over time. The wave height depends upon the SEN submergence depth, as the wave is typically higher with shallow submergence. The wave height also depends on the port angle and opening area, as smaller angles and smaller area typically yield a higher wave height. Surface turbulence and standing waves are probably the most important factors affecting cast quality. The wave and recirculations oscillate from one side to another, adversely affecting the quality of the cast.

The flow is further biased due to the influence of the slide gate or preferential nozzle blockage. The biased flow increases the chances of mold flux slag entrainment. A larger jet angle downward from the horizontal helps in reducing the surface turbulence and wave height by pushing the impingement point to a lower depth in the mold. A lower impingement point, however, results in a thin solidified shell at the exit from the mold and associates itself with a danger of breakout. Another problem is that a deeper lower recirculation carries the inclusions down to much greater depth and affects the quality of cast metal.

Accordingly, it is an object of the present invention to provide an apparatus and method for continuous casting of metal that provides for a flatter and less turbulent free surface to provide effective flux flow while also allowing for more efficient removal of inclusions and allowing for potential reduction in the risk of break out. This is expected to reduce surface and subsurface defects in the cast slab associated with this surface wave and turbulence.

Although described with respect to the field of steel casting, it will be appreciated that similar advantages of surface wave damping, along with other advantages, may obtain in other applications of the present invention. Such advantages may become apparent to one of ordinary skill in the art in light of the present disclosure or through practice of the invention.

SUMMARY OF THE INVENTION

The invention includes a molten metal vessel system for casting molten metal and a method of providing a flow of molten metal for continuous casting.

In general terms, the apparatus of the present invention includes a molten metal vessel system for casting molten metal, the system comprising: (a) a vessel containing a molten metal adapted to contain and dispense the molten metal for casting, the vessel having interior surfaces and the molten metal forming an upper surface; (b) a submerged entry nozzle extending below the upper surface; and (c) a surface flow modifier member disposed between at least one of the interior surfaces and the submerged entry nozzle, and in sufficient proximity to the upper surface of the molten metal so as to impede the formation of waves in the upper surface of the molten metal.

Preferably, the surface flow modifier member(s) are located on either side of the submerged entry nozzle, and a series of surface flow modifier member(s) may be used on either side of the submerged entry nozzle.

The surface flow modifier member(s) typically extend into the molten metal surface, although they may be adapted to reside just above the free surface of the molten metal so as to impede the formation of waves in the upper metal surface. Normally, the molten metal surface will bear a flux layer and the surface flow modifier member(s) will extend into the flux layer and/or the molten metal.

In general, the invention is not limited to any geometry of the surface flow modifier member(s). For instance, in one embodiment, the surface flow modifier member(s) may be shaped so as to provide a relatively thin portion adapted to extend through the flux layer and a relatively wide portion adapted to extend into the molten metal. In another embodiment, the surface flow modifier member(s) comprise (s) a plurality of tines adapted to extend through the flux layer and a relatively wide portion adapted to extends into the molten metal. These geometries are examples of preferred geometries that impede turbulence and wave action while allowing as much as practicable the free and uniform flow of flux on the free metal surface.

In still another embodiment, the surface flow modifier member(s) comprise(s) a lower portion being tapered away from the submerged entry nozzle and toward the interior surface, so as to be somewhat trapezoidal in shape.

The surface flow modifier member may be supported in contact with or in functional proximity to the free metal surface by any appropriate mechanical means, such as through a bracket attached to the casting mold. Being attached to a structure other than the casting mold may also support the surface flow modifier member. Materials and attachment protocols may be any of those appropriate for the handling of temperature resistant materials, such as refractory ceramics. It is preferred that the surface flow modifier member(s) not contact the interior mold surface to avoid disrupting both the solidification of metal and the mold was and the flow of flux into the casting mold.

Another aspect of the present invention is that the surface flow modifier member(s) or other surface wave impedance means allows the submerged entry nozzle optionally to direct the flow of molten metal at an angle at or above the horizontal (rather than the typical downward angled flow). This feature helps both to allow the more efficient elimination of inclusions during the casting process, while avoiding the risk of high temperature break-out in the freshly solidified layer as it emerges from the mold occasioned by the hot molten metal being directed too low and too near the downstream end of the casting mold.

The molten metal vessel system for casting molten metal of the invention also includes (a) a vessel containing a molten metal adapted to contain and dispense the molten metal for casting, the vessel having interior surfaces and the molten metal forming an upper surface; (b) a submerged entry nozzle extending below the upper surface; and (c) means for impeding the formation of waves in the upper surface of the molten metal.

The means for impedance of the formation of waves in the upper surface of the molten metal is accomplished by application of mechanical force (such as in the form of the surface flow modifier member or equivalent mechanical arrangement or device), fluid force (such as in the form of a gaseous flow directed against the free metal surface), or through application of electromagnetic force (such as through use of electromagnetic actuators used for other purposes of controlling molten metal in the industry).

The present invention also includes a method of providing a flow of molten metal for continuous casting, the method comprising: (a) providing a vessel containing a molten metal adapted to contain and dispense the molten metal for casting, the vessel having interior surfaces and the molten metal forming an upper surface; (b) conducting a flow of molten metal below the upper surface of the molten metal while impeding the formation of waves in the upper surface of the molten metal; and (c) allowing the molten metal to exit the vessel so as to form a metal casting.

The impedance of the formation of waves in the upper surface of the molten metal may be accomplished by application of mechanical device, fluid force or electromagnetic force as described above.

The submerged entry nozzle may direct a flow of molten metal at an angle at, above, or slightly below the horizontal, although it is preferred that the angle be slightly below the horizontal, (i.e. 1–20% below the horizontal).

The present invention thus provides a simple method through which a piece of refractory or other temperature-resistant member (referred to generally as a "surface flow modifier") is inserted, or otherwise engages, the free surface, preferably from the top near and preferably on either side of the SEN. The surface flow modifier(s) impede(s) the top recirculating flow and waves formed thereby, which in turn, significantly slows the surface velocity, and makes the free surface nearly flat. This is schematically shown in FIG. 2.

Defects caused by the free surface wave or turbulence will be reduced or even practically eliminated.

Because the metal solidifies in contact with the mold wall, the surface flow modifier preferably should not touch the mold wall. Thus, it is typically necessary to maintain a gap between the surface flow modifier and the mold wall.

FIG. 3 shows the side view of the mold with the surface flow modifier.

This concept has been tested and proven to work in a small-scale water model. The shape, size and location of the surface flow modifier(s) will depend upon the particular system. The surface flow modifier should not slow down the flow so much that the metal freezes excessively near the free surface. A general three-dimensional schematic of the system is shown in FIG. 3*a*. Since the surface flow modifier reduces the free surface turbulence, the flow becomes symmetrical on both sides of the SEN and significantly reduces the biased flow.

This device is expected to provide much better control and significantly improve the quality of the cast metal.

DETAILED DESCRIPTION OF THE PREFERRED EMBODIMENTS

Figure 1:
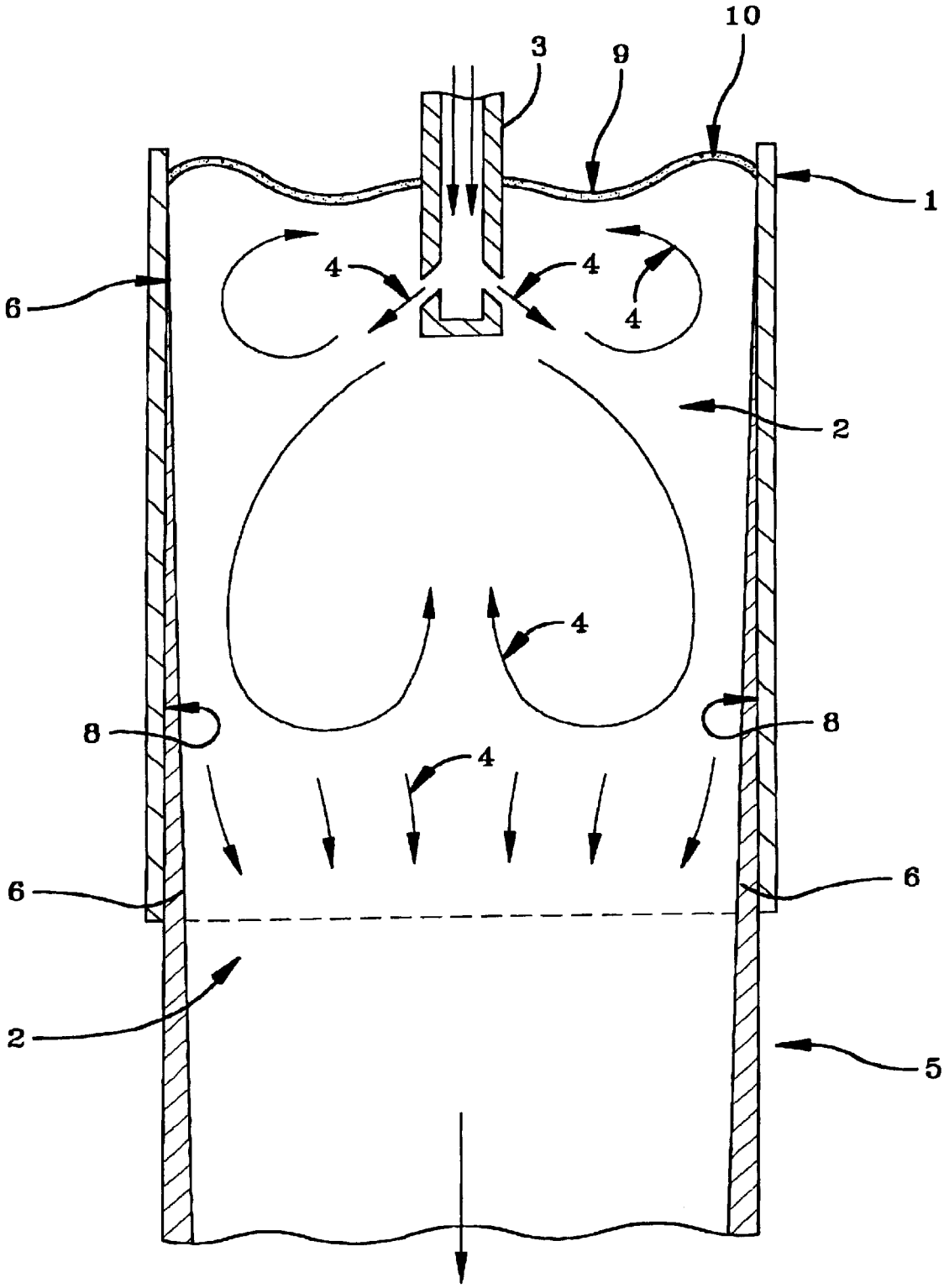
FIG-1 PRIOR ART
FIG. 1 shows a front sectioned elevation view of a continuous casting system showing a general flow pattern in a continuous casting mold.

In accordance with the foregoing summary, the following presents a detailed description of the preferred embodiments, which are presently considered to include the best mode of the invention. Where possible, like reference numerals are used in the figures subsequent to FIG. 1 in accordance with the description of FIG. 1 for common components and features.

FIG. 1 shows a sectioned elevation view of a continuous casting system showing a general flow pattern in a continuous casting mold. FIG. 1 shows continuous casting mold 1 and molten metal 2 entering the continuous casting mold 1 as the metal emerges from submerged entry nozzle 3. The molten metal flows generally along flow lines 4 as it enters the continuous casting mold 1, and emerges from the mold as a partially solidified slab 5 in the shape of the mold (typically rectangular). As the molten metal 2 progresses through the mold, a layer of solidified steel 6 is formed against the interior surfaces 8 of the mold 1 to make a shell over the freshly cast slab. The downward movement of the metal through the mold is facilitated by a layer of flux 9 (atop free molten metal surface 10) that extends between the interior surfaces 8 and the layer of solidified steel 6 (not shown in thickness).

Figure 2:
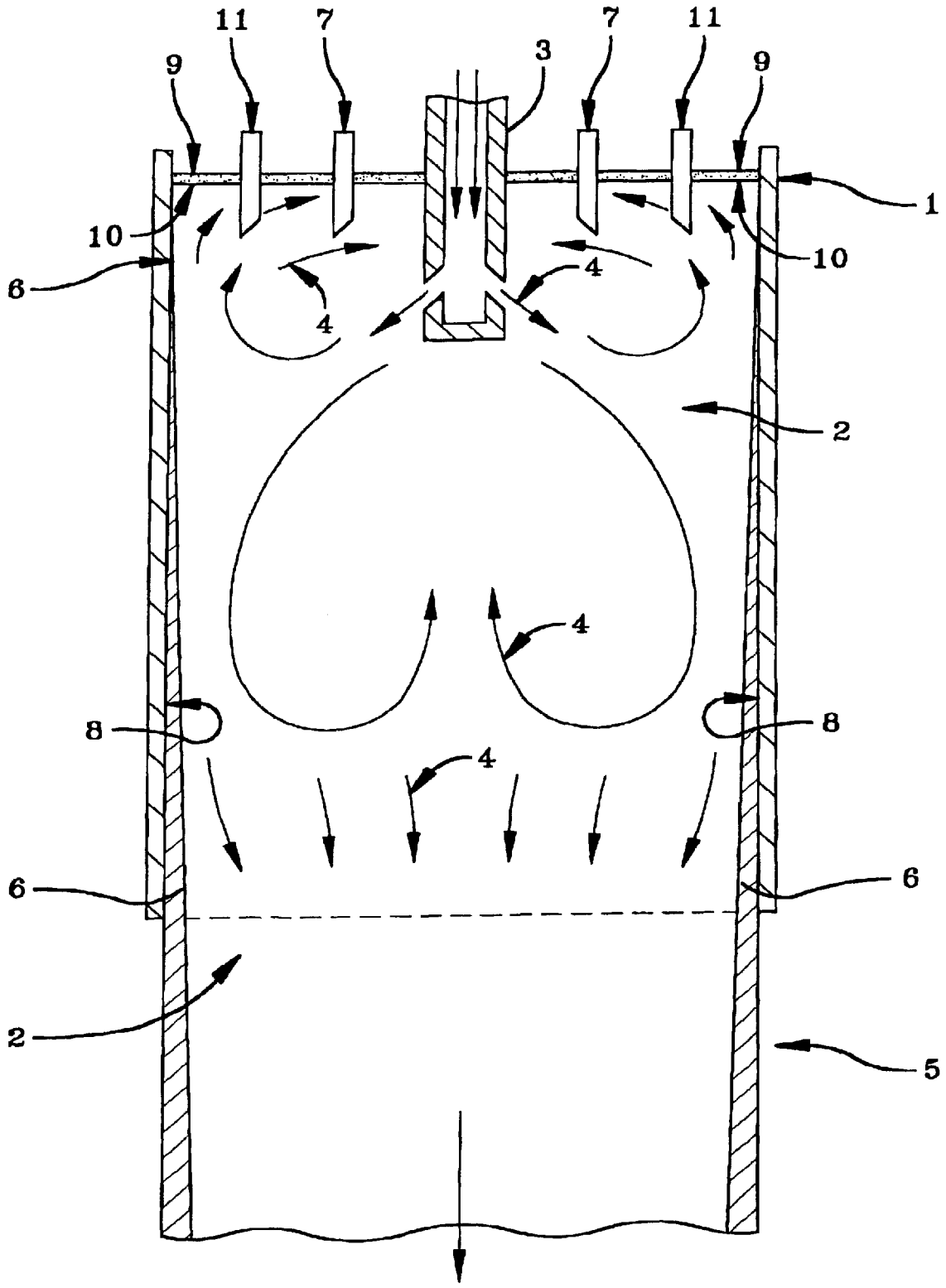
FIG. 2 shows a front sectioned elevation view of a continuous casting system showing a general flow pattern in a continuous casting mold, and showing surface flow modifiers in accordance with one embodiment of the present invention.

FIG. 2 shows a front sectioned elevation view of a continuous casting system showing a general flow pattern in a continuous casting mold, and showing a pair of surface flow modifiers 11 in accordance with one embodiment of the present invention. In an alternative embodiment of the present invention, a second pair of surface flow modifiers 7 are positioned, one on each side of the entry nozzle 3. It is appreciated that different quantities and arrangements of surface flow modifiers may be used without departing from the scope of the present invention.

FIG. 2 shows the flow lines that would cause turbulence affecting the free surface 10 of the molten metal 2 bearing flux layer 9. Surface flow modifier member 11 extends into the metal surface 10 through flux layer 9, but preferably does not touch interior surfaces, such as interior surface 8, below the level of the molten metal 2. Surface flow modifier member 11 reduces the turbulence in the molten metal 2, thus reducing wave formation in the free surface 10, while maintaining the free flow of flux material to the outer edges of the free surface 10, so that the flux can flow uniformly along the mold sides without disturbing the solidified metal layer.

Figure 2A:
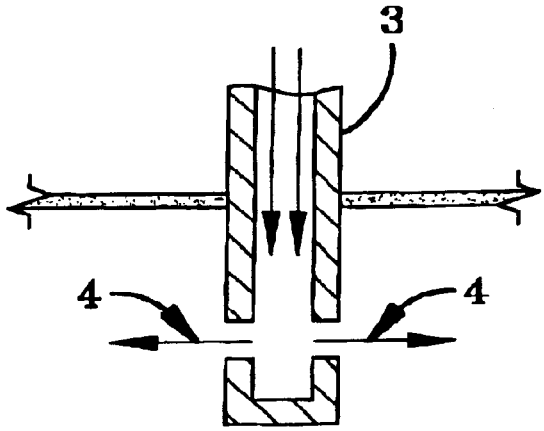
FIG. 2*a* shows an exploded view of a front sectioned elevation view of the submerged entry nozzle having horizontal molten metal discharge in accordance with one embodiment of the present invention.

FIG. 2*a* shows an exploded view of an alternative embodiment of the submerged entry nozzle 3. In the embodiment depicted in FIG. 2*a*, the ports of the submerged entry nozzle is adapted to cause the molten metal to exit the nozzle in an horizontal direction 4.

Figure 2B:
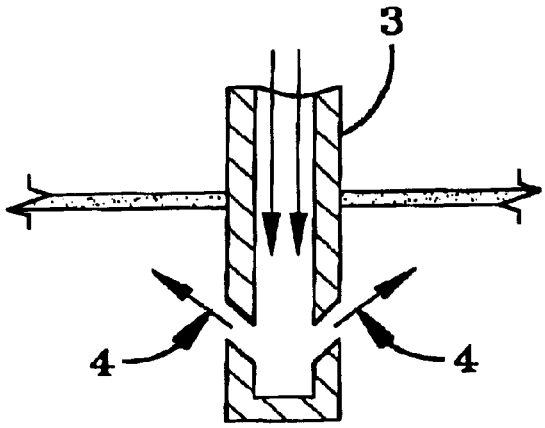
FIG. 2*b* shows an exploded view of a front sectioned elevation view of the submerged entry nozzle having an upwardly flowing molten metal discharge in accordance with one embodiment of the present invention.

FIG. 2*b* shows an exploded view of another alternative embodiment of the submerged entry nozzle 3. In the embodiment depicted in FIG. 2*b*, the opening of the submerged entry nozzle is adapted to cause the molten metal to exit the nozzle in an upward direction 4 from the horizontal.

Figure 2C:
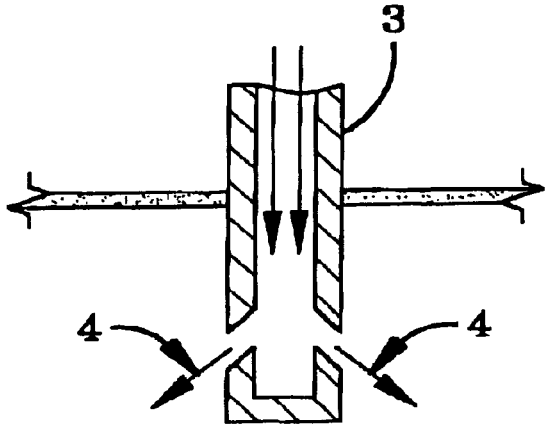
FIG. 2*c* shows a front sectioned elevation view of the submerged entry nozzle having a downwardly flowing molten metal discharge in accordance with one embodiment of the present invention.

FIG. 2*c* shows an exploded view of another embodiment of the submerged entry nozzle 3. In the embodiment depicted in FIG. 2*c*, the opening of the submerged entry nozzle is adapted to cause the molten metal to exit the nozzle in a downward direction 4 from the horizontal.

Figure 3:
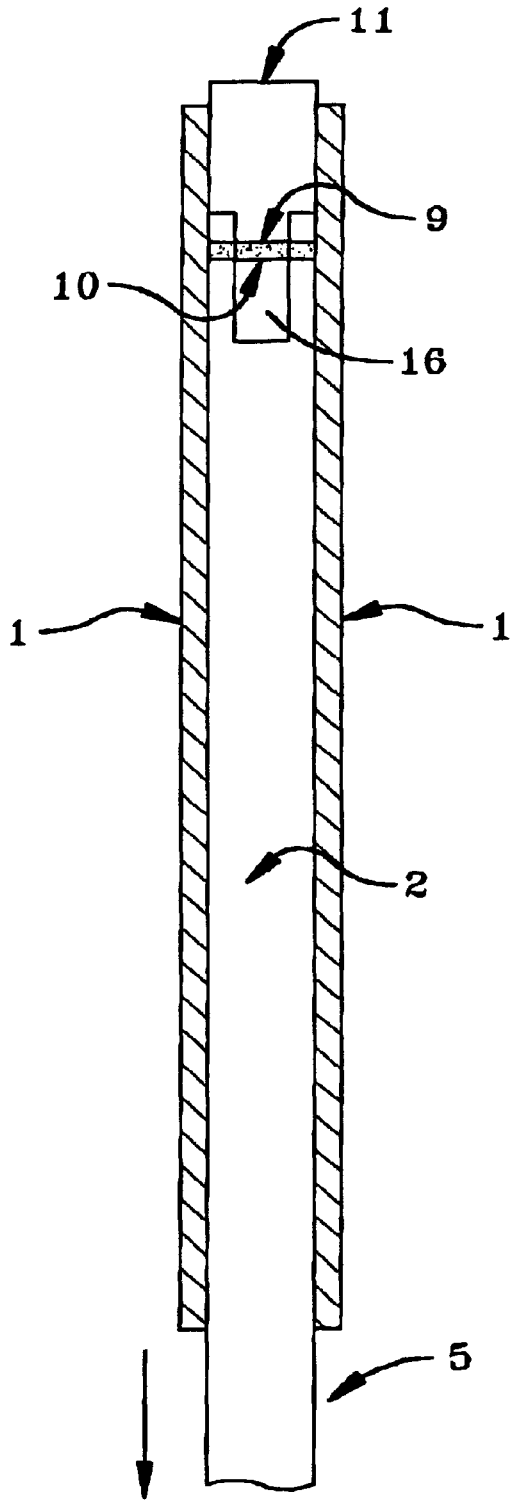
FIG. 3 shows a side view schematic of a continuous casting system showing a general flow pattern in a continuous casting mold, and showing a surface flow modifier in accordance with one embodiment of the present invention.

FIG. 3 shows a side sectioned elevation view of the continuous casting system of FIG. 2. FIG. 3 shows the surface flow modifier member 11 in its position attached to the sides of mold 1. As can be seen from FIG. 3, the surface flow modifier member 11 is adapted to have a lower portion 16, the lower portion 16 being of sufficient length so as to cause it to be extended through the flux layer 9 and submersed in the molten metal 2. The lower portion 16 of the surface flow modifier member 11 is further adapted to be sufficiently narrow so as to maintain a space between the outer edges of the lower portion 16 and the interior surface 8 of the continuous casting mold 1. Maintaining a space between the lower portion and interior surface 8 of the mold allows greater continuity of the flux layer 9 as it flows atop the molten metal surface 10, without attendant dispurtion solidifying metal.

Figure 3A:
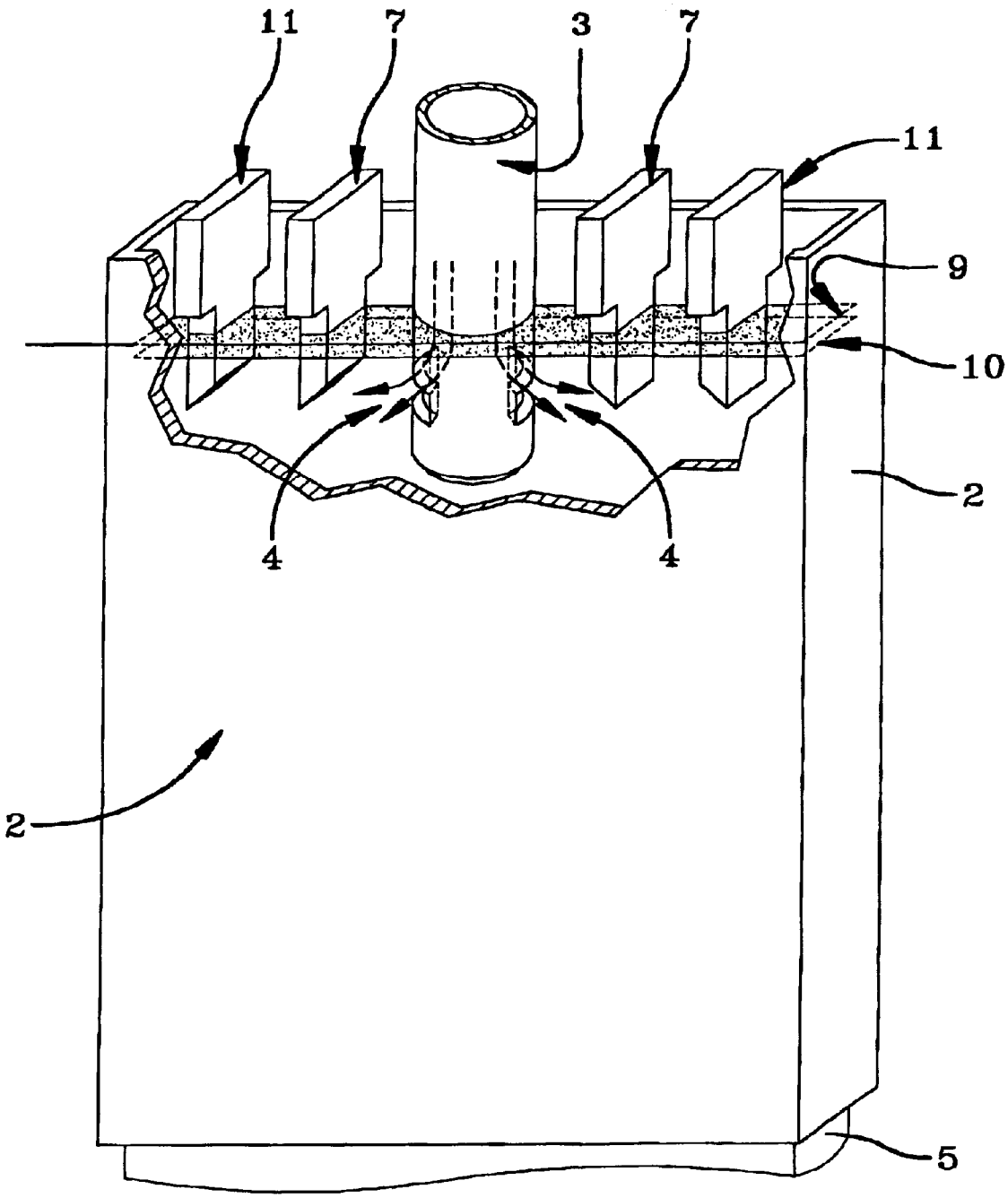
FIG. 3*a* shows a perspective view schematic of a continuous casting system showing a general flow pattern in a continuous casting mold, and showing at least one surface flow modifier in accordance with one embodiment of the present invention.

FIG. 3*a* shows a perspective view of the continuous casting system of FIG. 2. FIG. 3*a* also depicts the additional surface flow modifiers 7 of an alternative embodiment.

Figure 4:
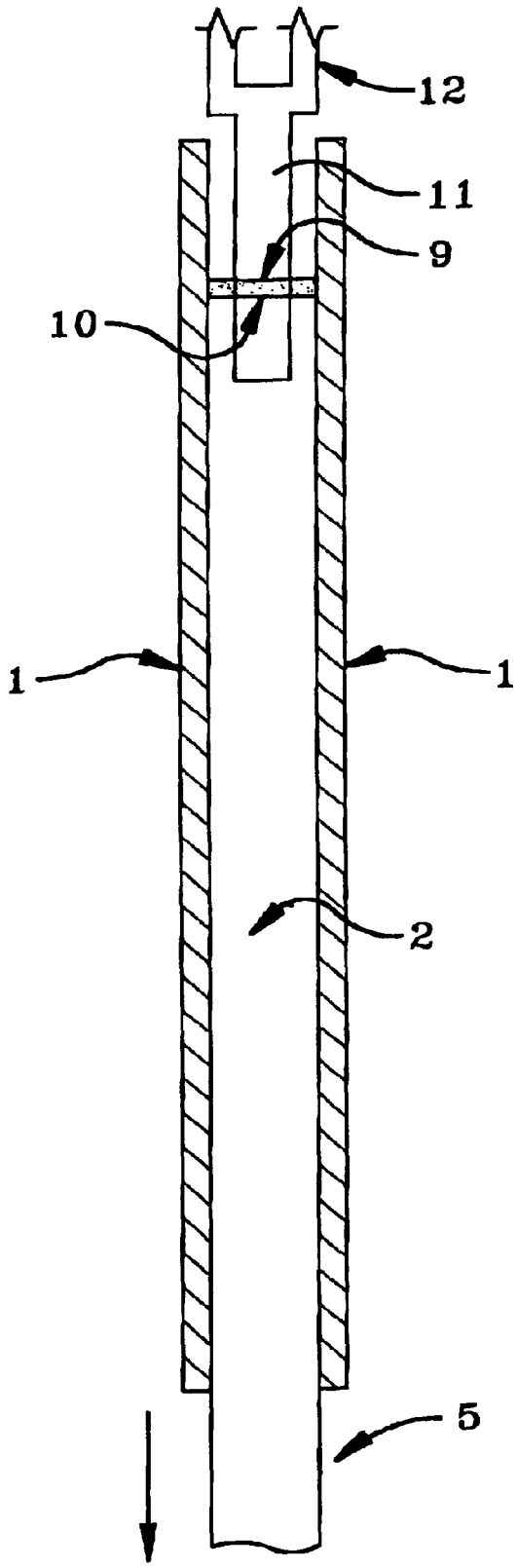
FIG. 4 shows a side view schematic of a continuous casting system showing a continuous casting mold, and showing an externally supported surface flow modifier in accordance with one embodiment of the present invention.

FIG. 4 shows a side sectioned elevation view of an alternative embodiment of the continuous casting system of FIG. 2. As can be seen in FIG. 4, the surface flow modifier 11 is adapted to be externally supported, the surface flow modifier 11 having an upper portion 12, the upper portion 12 being affixed to any suitable, dimensionally stable external member. It is appreciated that in this alternative embodiment, a plurality of differently shaped surface flow modifiers can be adapted to be externally supported.

Figure 5:
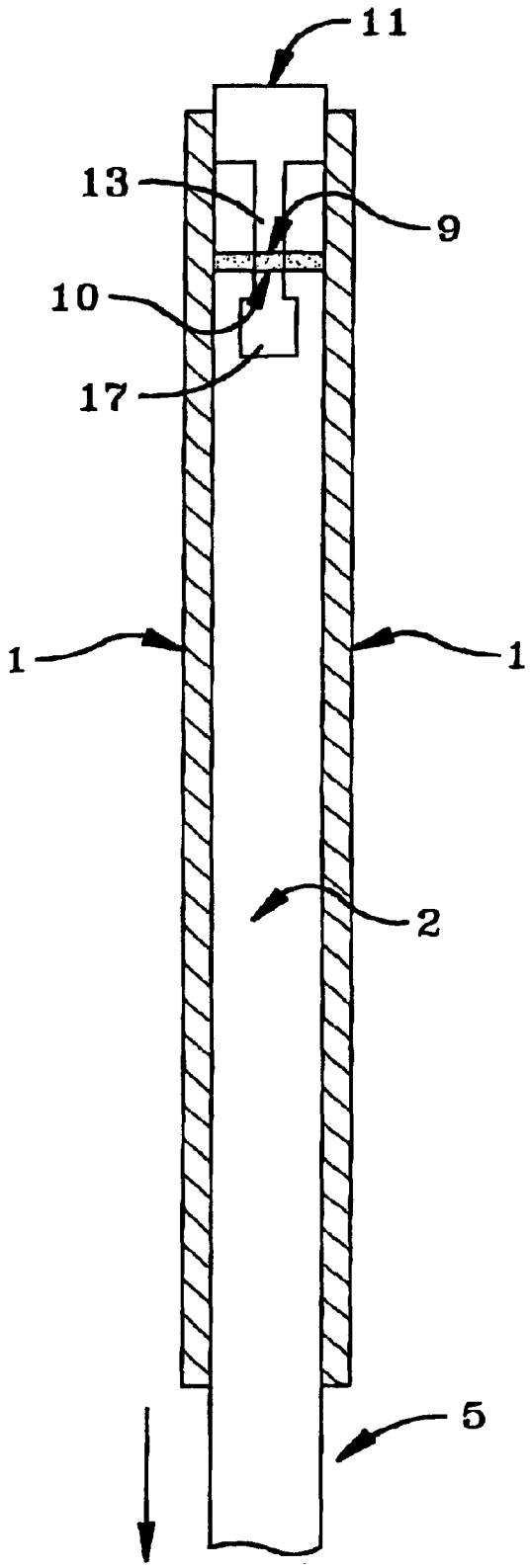
FIG. 5 shows a side view schematic of a continuous casting system showing a continuous casting mold, and showing a paddle shaped surface flow modifier in accordance with one embodiment of the present invention.

FIG. 5 shows a side sectioned elevation view of another alternative embodiment of the continuous casting system of FIG. 2. As can be seen in FIG. 5, the surface flow modifier 11 is adapted to have a relatively thin portion 13, the relatively thin portion 13 being adapted to extend through the flux layer 9 and into the molten metal 2. The surface flow modifier 11 is further adapted to have a relatively wide portion 17, the relatively wide portion 17 being permanently affixed to the relatively thin portion 13. In the alternative embodiment depicted, the surface flow modifier 11 is positioned so that the relatively wide portion 17 is completely submersed in the molten metal 2.

Figure 6:
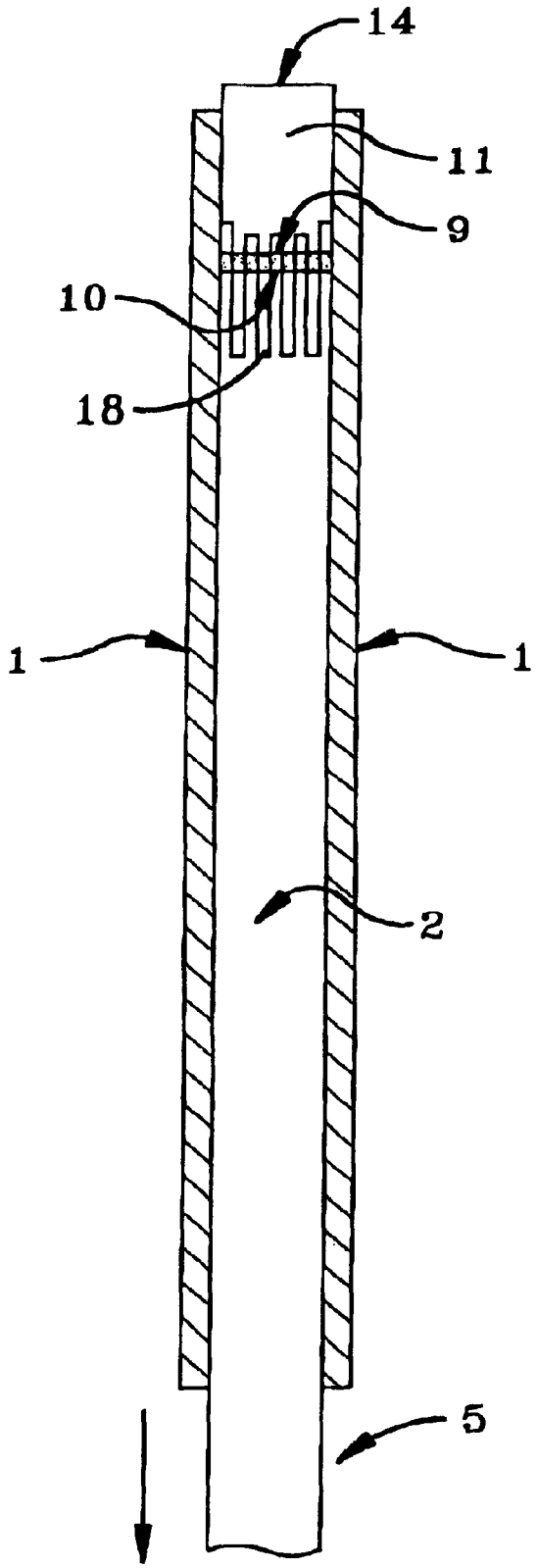
FIG. 6 shows a side view schematic of a continuous casting system showing a continuous casting mold, and showing a surface flow modifier having a plurality of tines in accordance with one embodiment of the present invention.

FIG. 6 shows a side sectioned elevation view of another alternative embodiment of the continuous casting system of FIG. 2. As can be seen in FIG. 6, the surface flow modifier 11 is adapted to have a plurality of tines 18, the tines being adapted so that the upper portion of the tines is above the flux layer 9 and the lower portion extends through the flux layer 9 and into the molten metal 2.

Figure 7:
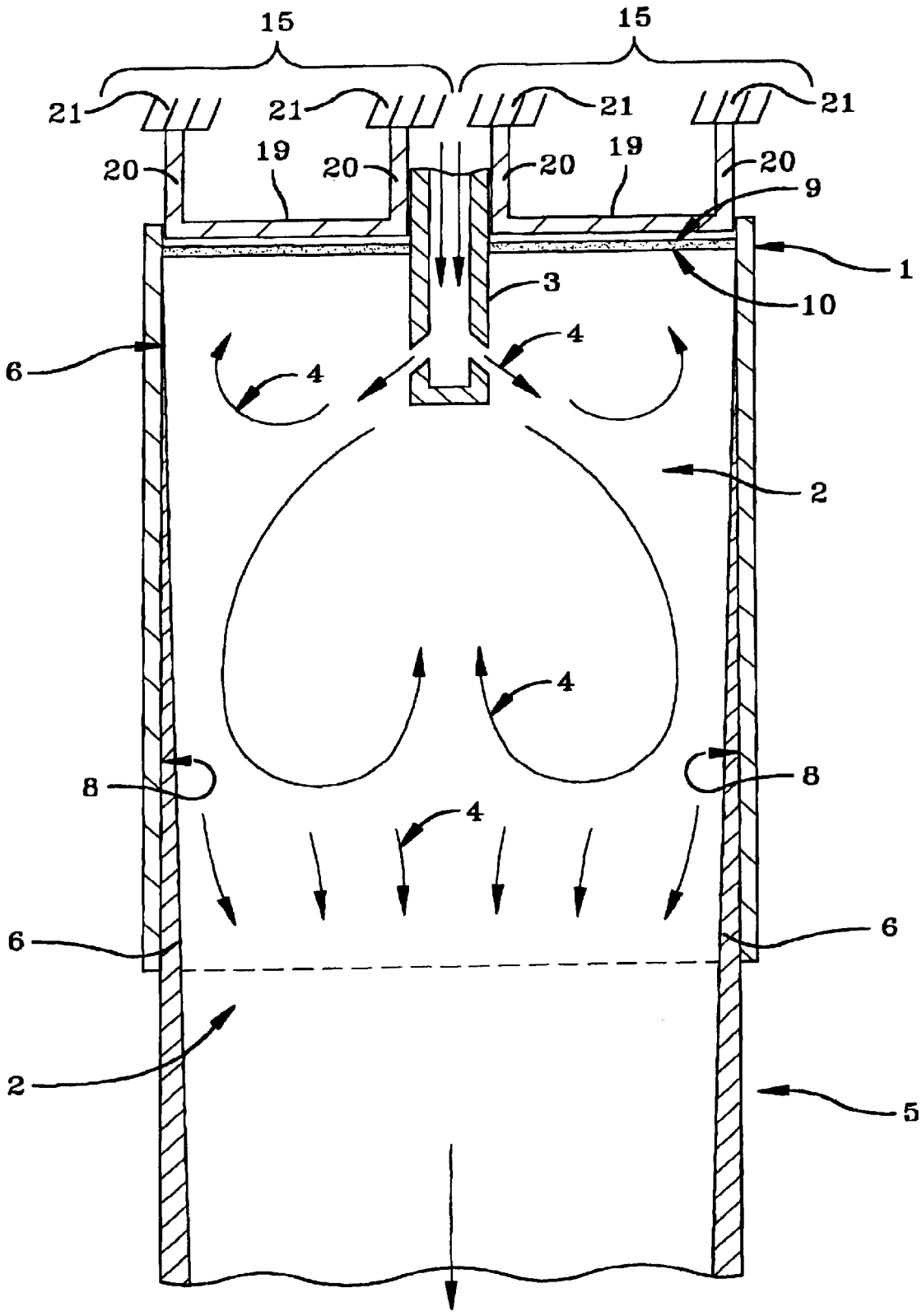
FIG. 7 shows a front-sectioned elevation view of a continuous casting system showing a continuous casting mold, and showing a surface flow modifier member in accordance with one embodiment of the present invention.

FIG. 7 shows a front-sectioned elevation view of a continuous casting system depicting another alternative embodiment of the present invention. The surface flow modifiers, as depicted in FIG. 2, are replaced with surface flow modifier members 15. As depicted in FIG. 7, there are two surface flow modifier members positioned on each side of the submerged entry nozzle 3 and being located between the submerged entry nozzle 3 and inner wall 8 of the mold 1. The surface flow modifier members 15 are positioned sufficiently close to the flux layer 9 so as to make contact with the flux layer 9, the surface flow modifier members 15 being further adapted not to extend through the flux layer 9. The surface flow modifier members 15 being U-shaped in cross section and having a lower contact portion 19 having a sufficiently flat planar surface for clipping waves as they are formed on the free surface 10 of the molten metal 2.

In FIG. 7, the surface flow modifier members 15 are adapted to have a support portion 20, the support portion 20 being adapted so as to be capable of being permanently affixed to external support members 21. The external support members 21 comprising any dimensionally stable external support means.

Figure 8:
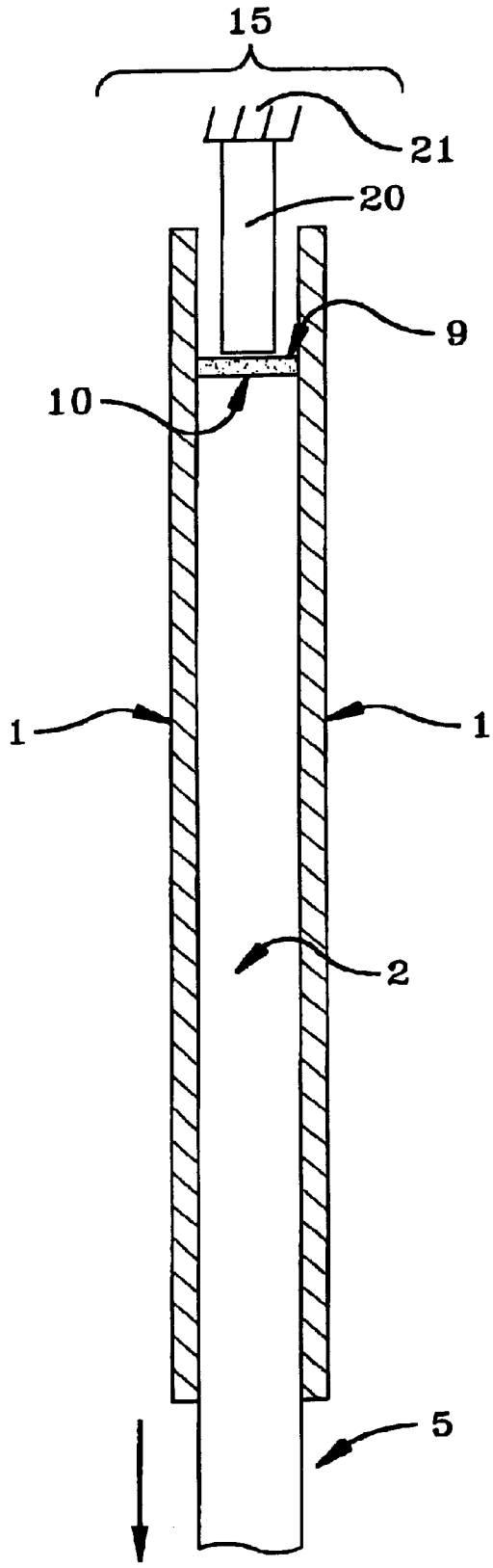
FIG. 8 shows a side view schematic of a continuous casting system showing a continuous casting mold, and showing a surface flow modifier member in accordance with one embodiment of the present invention.

FIG. 8 shows a side sectioned elevation view of the continuous casting system of FIG. 7 having the surface flow modifier members 15 instead of the surface flow modifiers of FIG. 2. As can be seen in FIG. 8, the sides of the surface flow modifier member 15 are positioned so as to be sufficiently close but not in contact with the sides of the mold 1.

The preferred embodiments herein disclosed are not intended to be exhaustive or to unnecessarily limit the scope of the invention. The preferred embodiments were chosen and described in order to explain the principles of the present invention so that others skilled in the art may practice the invention. Having shown and described preferred embodiments of the present invention, it will be within the ability of one of ordinary skill in the art to make alterations or modifications to the present invention, such as through the substitution of equivalent materials or structural arrangements, or through the use of equivalent process steps, so as to be able to practice the present invention without departing from its spirit as reflected in the appended claims, the text and teaching of which are hereby incorporated by reference herein. It is the intention, therefore, to limit the invention only as indicated by the scope of the claims and equivalents thereof.

What is claimed is:

1. A continuous casting system for impeding wave formation, said system comprising:

a continuous casting mold, said continuous casting mold adapted to receive a flow of molten metal, to contain said molten metal, and to dispense said molten metal for casting, said continuous casting mold comprising interior surfaces, said interior surfaces comprising major interior surfaces and minor interior surfaces, said continuous casting mold having an inner length, an inner width, and an inner height, wherein each said major interior surface is defined by said inner length and said inner height, each said minor interior surface is defined by said inner width and said inner height, and wherein said molten metal forms an upper metal surface;

a submerged entry nozzle extending below said upper metal surface, said submerged entry nozzle comprising at least one discharge orifice adapted to dispense said flow of molten metal into said continuous casting mold below said upper metal surface; and at least one surface flow modifier member, each said surface flow modifier having a thickness, a width and a height, each said surface flow modifier further having at least one major face defined by said width and said height, at least one surface flow modifier extending below said upper metal surface, each said surface flow modifier terminating above said at least one discharge orifice, wherein at least a portion of each said surface flow modifier is sufficiently wide enough to substantially span said inner width of said continuous casting mold without a said surface flow modifier touching said interior surfaces below said upper metal surface, each said surface flow modifier vertically disposed between said submerged entry nozzle and a said interior surface of said continuous casting mold such that at least one said major face is substantially orthogonal to said flow of molten metal in said continuous casting mold so as to impede formation of waves in said upper metal surface.

2. A continuous casting system according to claim 1 further comprising a flux layer, said flux layer disposed above said upper metal surface.

3. A continuous casting system according to claim 1 further comprising a flux layer and wherein said at least one surface flow modifier member extends into said flux layer and into said molten metal.

4. A continuous casting system according to claim 3 wherein said at least one surface flow modifier member comprises a relatively thin portion adapted to extend through said flux layer and a relatively wide portion adapted to extend into said molten metal.

5. A continuous casting system according to claim 3 wherein said at least one surface flow modifier member comprises a plurality of tines.

6. A continuous casting system according to claim 3 wherein said at least one surface flow modifier member comprises a plurality of tines adapted to extend through said flux layer into said molten metal.

7. A continuous casting system according to claim 1 wherein said at least one surface flow modifier member comprises a lower portion being tapered away from said submerged entry nozzle.

8. A continuous casting system according to claim 1 wherein said submerged entry nozzle is adapted to direct a flow of molten metal at an angle at, above, or slightly below horizontal.

9. A method of impeding wave formation in a continuous casting mold, said method comprising:

providing a continuous casting mold, said continuous casting mold adapted to receive a flow of molten metal, to contain said molten metal, and to disperse said molten metal for casting, said continuous casting mold comprising interior surfaces, said interior surfaces comprising major interior surfaces and minor interior surfaces, said continuous casting mold having an inner length, an inner width, and an inner height, wherein each major interior surface is defined by said inner length and said inner height, each said minor interior surface is defined by said inner width and said inner height, and wherein said molten metal forms an upper metal surface;

conducting a flow of molten metal below said upper surface of said molten metal, said flow of molten metal entering said continuous casting mold through a submerged entry nozzle extending below said upper metal surface, said submerged entry nozzle comprising at least one discharge orifice adapted to dispense said flow of molten metal into said continuous casting mold below said upper metal surface; and impeding wave formation by contacting said molten metal with at least one surface flow modifier, each said surface flow modifier having a thickness, a width, and a height, each said surface flow modifier further having at least one major face defined by said width and said height, at least one said surface flow modifier extending below said upper metal surface, each said surface flow modifier terminating above said at least one discharge orifice, wherein at least a portion of each said surface flow modifier is sufficiently wide enough to substantially span said inner width of said continuous casting mold without a said surface flow modifier touching said interior surfaces below said upper metal surface, each said surface flow modifier vertically disposed between said submerged entry nozzle and a said interior surface of said continuous casting mold such that at least one major face is substantially orthogonal to said flow of molten metal in said continuous casting mold.

10. A method according to claim 9 wherein said impedance of said formation of waves in said upper surface of said molten metal is accomplished by application of mechanical force.

11. A method according to claim 9 wherein said impedance of said formation of waves in said upper surface of said molten metal is accomplished by application of fluid force.

12. A method according to claim 9 wherein said molten metal is directed at an angle at, above, or slightly below a line normal to the horizontal.

13. A continuous casting system for impeding wave formation, said system comprising:

a continuous casting mold, said continuous casting mold adapted to receive a flow of molten metal, to contain said molten metal, and to dispense said molten metal for casting, said continuous casting mold comprising interior surfaces, said interior surfaces comprising major interior surfaces and minor interior surfaces, said continuous casting mold having an inner length, an inner width, and an inner height, wherein each said major interior surface is defined by said inner length and said inner height, each said minor interior surface is defined by said inner width and said inner height, and wherein said molten metal forms an upper metal surface;

a submerged entry nozzle extending below said upper metal surface, said submerged entry nozzle comprising at least one discharge orifice adapted to dispense said flow of molten metal into said continuous casting mold below said upper metal surface; and at least one surface flow modifier member, each said surface flow modifier having a thickness, a width, a height, an upper end extending through said upper metal surface and a lower end, each said surface flow modifier further having at least one face defined by said width and said height, at least one surface flow modifier positioned such that said lower end extends below said upper metal surface, wherein at least a portion of each said surface flow modifier is sufficiently wide enough to substantially span said inner width of said continuous casting mold without a said surface flow modifier touching said interior surfaces below said upper metal surface, each said surface flow modifier vertically disposed between said submerged entry nozzle and a said interior surface of said continuous casting mold such that at least one said face is substantially orthogonal to said flow of molten metal in said continuous casting mold so as to impede formation of waves in said upper metal surface.

14. A method of impeding wave formation in a continuous casting mold, said method comprising:

providing a continuous casting mold, said continuous casting mold adapted to receive a flow of molten metal, to contain said molten metal, and to disperse said molten metal for casting, said continuous casting mold comprising interior surfaces, said interior surfaces comprising major interior surfaces and minor interior surfaces, said continuous casting mold having an inner length, an inner width, and an inner height, wherein each major interior surface is defined by said inner length and said inner height, each said minor interior surface is defined by said inner width and said inner height, and wherein said molten metal forms an upper metal surface;

conducting a flow of molten metal below said upper surface of said molten metal, said flow of molten metal entering said continuous casting mold through a submerged entry nozzle extending below said upper metal surface, said submerged entry nozzle comprising at least one discharge orifice adapted to dispense said flow of molten metal into said continuous casting mold below said upper metal surface; and impeding wave formation by contacting said molten metal with at least one surface flow modifier, each said surface flow modifier having a thickness, a width, a height, an upper end extending through said upper metal surface and a lower end, each said surface flow modifier further having at least one face defined by said width and said height, at least one surface flow modifier positioned such that said lower end extends below said upper metal surface, wherein at least a portion of each said surface flow modifier is sufficiently wide enough to substantially span said inner width of said continuous casting mold without a said surface flow modifier touching said interior surfaces below said upper metal surface, each said surface flow modifier vertically disposed between said submerged entry nozzle and a said interior surface of said continuous casting mold such that at least one face is substantially orthogonal to said flow of molten metal in said continuous casting mold.

* * * * *